US009664160B2

(12) United States Patent
Park et al.

(10) Patent No.: US 9,664,160 B2
(45) Date of Patent: May 30, 2017

(54) VEHICULAR HIGH PRESSURE DIRECT INJECTION TYPE INJECTOR WITH VALVE SEAT BODY FOR FUEL-ATOMIZATION

(71) Applicant: Hyundai Kefico Corporation, Gunpo-si, Gyeonggi-do (KR)

(72) Inventors: Jeong-Hwan Park, Gunpo-si (KR); Hyoung-Jin Kim, Gunpo-si (KR)

(73) Assignee: HYUNDAI KEFICO CORPORATION, Gyeonggi-Do (KR)

( * ) Notice: Subject to any disclaimer, the term of this patent is extended or adjusted under 35 U.S.C. 154(b) by 0 days.

(21) Appl. No.: 14/416,230

(22) PCT Filed: Dec. 20, 2013

(86) PCT No.: PCT/KR2013/011976
§ 371 (c)(1),
(2) Date: Jan. 21, 2015

(87) PCT Pub. No.: WO2014/098529
PCT Pub. Date: Jun. 26, 2014

(65) Prior Publication Data

US 2015/0204287 A1 Jul. 23, 2015

(30) Foreign Application Priority Data

Dec. 20, 2012 (KR) ..... 10-2012-0149645

(51) Int. Cl.
*F02M 61/18* (2006.01)
*F02M 51/06* (2006.01)

(52) U.S. Cl.
CPC ..... *F02M 51/061* (2013.01); *F02M 51/0671* (2013.01); *F02M 61/184* (2013.01); *F02M 61/1833* (2013.01)

(58) Field of Classification Search
CPC .... F23D 11/10; F02M 53/043; F02M 61/168; F02M 61/18; F02M 61/1806; F02M 61/1826; F02M 61/1833; F02M 61/1866; F02M 61/184; F02M 61/1846; F02M 61/1853; F02M 61/1886; F02M 51/061;
(Continued)

(56) References Cited

U.S. PATENT DOCUMENTS 5,353,992 A 10/1994 Regueiro ..... 239/533.12
6,092,743 A * 7/2000 Shibata ..... F02B 17/005 239/533.12
(Continued)

FOREIGN PATENT DOCUMENTS

DE 10 2006 047 137 A1 4/2008
JP 10-288129 A 10/1998
(Continued)

*Primary Examiner* — Arthur O Hall
*Assistant Examiner* — Christopher R Dandridge
(74) *Attorney, Agent, or Firm* — Fitzpatrick, Cella, Harper & Scinto

(57) ABSTRACT

Disclosed herein is a vehicular high pressure direct injection type injector with valve seat body for fuel-atomization. A nozzle hole has an elliptical cross-section so that the fuel injection speed can be increased, whereby a fuel atomization effect can be maximized. Furthermore, a stepped hole is formed under the nozzle hole so that the nozzle hole can be fundamentally prevented from becoming clogged with combustion byproducts.

2 Claims, 18 Drawing Sheets

(58) Field of Classification Search
CPC ..... F02M 51/0671; F02M 51/1833; F02M 51/184; B05B 1/02; B05B 1/046; B05B 1/048; B05B 1/06
USPC ..... 239/430, 737, 132, 533.2, 558, 132.3, 239/427, 548, 553, 553.3, 557, 590, 590.3
See application file for complete search history.

(56) References Cited

U.S. PATENT DOCUMENTS 6,826,833 B1 12/2004 Maier et al. ..... 29/888.44
6,935,578 B1 * 8/2005 Shibata ..... B05B 1/3431 239/463
7,011,257 B2 * 3/2006 Heyse ..... F02M 51/0671 239/533.12
7,086,615 B2 * 8/2006 Joseph ..... F02M 61/168 239/533.12
7,243,865 B2 * 7/2007 Jarchau ..... B05B 1/00 222/566
7,434,752 B2 * 10/2008 Matsumoto ..... F02M 61/18 239/533.12
7,677,478 B2 * 3/2010 Maier ..... F02M 51/0671 239/533.12
7,832,661 B2 * 11/2010 Imoehl ..... F02M 61/168 239/533.12
2004/0262430 A1 12/2004 Joseph ..... 239/533.12
2009/0200402 A1 * 8/2009 Gesk ..... F02M 61/1853 239/533.12
2009/0321541 A1 * 12/2009 Holzgrefe ..... F02M 61/184 239/553.3
2012/0138892 A1 * 6/2012 Lee ..... H01L 27/15 257/13
2013/0313339 A1 * 11/2013 Carpenter ..... F02M 61/168 239/548

FOREIGN PATENT DOCUMENTS

JP 2002-221128 A 8/2002
JP 2004-027955 A 1/2004
JP 2006-002720 A 1/2006
JP 2007-177766 A 7/2007
KR 10-2007-0040959 A 4/2007
KR 10-2010-0077616 A 7/2010
WO WO 2007/043820 A1 4/2007
WO WO 2007/074385 A2 7/2007

* cited by examiner

VEHICULAR HIGH PRESSURE DIRECT INJECTION TYPE INJECTOR WITH VALVE SEAT BODY FOR FUEL-ATOMIZATION

TECHNICAL FIELD

The present invention relates, in general, to high-pressure direct injection injectors having fuel atomization valve seat bodies for vehicles and, more particularly, to a high-pressure direct injection injector having a fuel atomization valve seat body for vehicles in which a nozzle hole has an elliptical cross-section so that a fuel injection speed can be increased, whereby fuel atomization efficiency can be maximized, and in which a stepped hole is formed under the nozzle hole so that the nozzle hole can be fundamentally prevented from becoming clogged with combustion byproducts.

BACKGROUND ART

Generally, because injectors used in GDI engines for vehicles directly inject fuel into cylinders of the engines, atomization of fuel and atomizing patterns are very important. Such fuel atomization and atomizing patterns are influenced by the shape of a nozzle. Typically, an injector for vehicles is installed in a cylinder. For this reason, a valve seat is under high-temperature and high-pressure conditions, and there may be a problem of a nozzle becoming clogged with combustion byproducts, for example, carbon monoxide, soot, etc.

Conventional injection nozzles have a true-circular shape, and a fuel injection length that is relatively long. Furthermore, a fuel injection speed is comparatively low and fuel droplets are not completely vaporized, thus causing incomplete combustion, and causing combustion byproducts to be deposited, thereby resulting in blockage of the injection nozzle. Accordingly, fuel atomization efficiency is reduced, leading to incomplete combustion. As a result, problems such as air pollution and a reduction in the output of the engine are caused.

In an effort to overcome the problems of low combustion efficiency and air pollution, an injector having a conical nozzle hole which is increased in cross-sectional area in a direction in which fuel is injected was introduced in U.S. Pat. No. 5,353,992. However, in this structure, because of a low fuel injection speed, fuel atomization efficiency is still low. In addition, the problem of emission of noxious gas resulting from incomplete combustion, for example, carbon monoxide, is also not effectively mitigated.

Therefore, there is a need for a technique pertaining to an injector having a nozzle hole structure that can increase fuel injection speed and thus enhance fuel atomization efficiency.

DISCLOSURE

Technical Problem

Accordingly, the present invention has been made keeping in mind the above problems occurring in the prior art, and an object of the present invention is to provide a high-pressure direct injection injector having a fuel atomization valve seat body for vehicles in which a nozzle hole has an elliptical cross-section so that a fuel injection speed can be increased, whereby fuel atomization efficiency can be maximized, and in which a stepped hole is formed under the nozzle hole so that the nozzle hole can be fundamentally prevented from becoming clogged with combustion byproducts.

Technical Solution

In accordance with an aspect of the present invention to accomplish the above object, there is provided a high-pressure direct injection injector for vehicles, including: a cylindrical housing having a needle valve therein; a magnetic coil reciprocating the needle valve; a current supply line supplying current to the magnetic coil; a return spring disposed on an upper end of the needle valve, the return spring applying restoring force to the needle valve; a valve seat body disposed in a lower end of the cylindrical housing; and a ball disposed between the valve seat body and the needle valve, the valve seat body having a valve seat surface onto which the ball is seated, and a nozzle hole formed in the valve seat body in a direction in which fuel is injected, the nozzle hole having an elliptical horizontal cross-section.

The seat valve body may have a plurality of the nozzle holes.

The horizontal cross-section of the nozzle hole may be an ellipse having a minor axis to a major axis ratio of 1:1 to 3.5.

Furthermore, a side surface of the nozzle hole may be tapered in such a way that a horizontal cross-sectional area of the nozzle hole is increased in the direction in which the fuel is injected.

The side surface of the nozzle hole is tapered in such a way that a horizontal cross-sectional area of the nozzle hole is reduced in the direction in which the fuel is injected.

The high-pressure direct injection injector may further include a stepped hole formed under the nozzle hole, the stepped hole having a larger cross-sectional area than the cross-sectional area of the nozzle hole.

Advantageous Effects

In a vehicular high pressure direct injection type injector with valve seat body for fuel-atomization in accordance with the present invention having the above configuration, a nozzle hole has an elliptical cross-section, so that fuel atomization efficiency can be markedly enhanced. Thereby, complete combustion can be achieved, thus enhancing the efficiency of the engine, and reducing emission of noxious gas, thereby mitigating the problem of environmental pollution.

Furthermore, improvement in the shape of the nozzle hole can minimize combustion byproducts that are created by operation of the injector for vehicles from being deposited in the nozzle. As a result, the combustion efficiency of an engine can be enhanced, and the nozzle clogging problem can be prevented.

In addition, the nozzle hole is configured in such a way that the diameter of the lower end of the nozzle hole is larger or smaller than that of the upper end of the nozzle hole, whereby the fuel injection speed can be enhanced, and fuel atomization efficiency is enhanced compared to a conventional injector.

Moreover, a stepped hole is formed under the nozzle hole, thus preventing the nozzle hole from becoming clogged with combustion byproducts.

DESCRIPTION OF THE REFERENCE NUMERALS IN THE DRAWINGS

Figure 1:
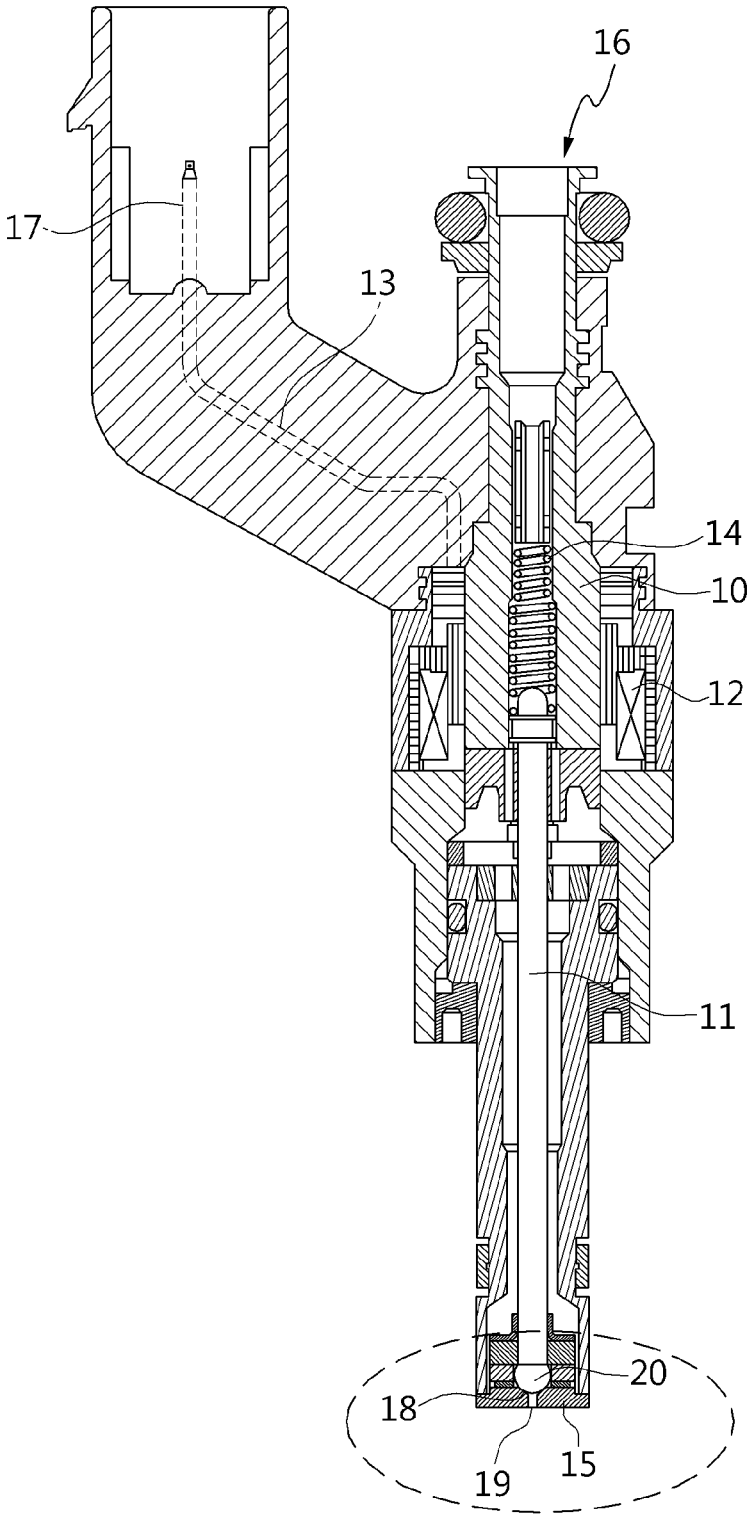
FIG. 1 is a sectional view illustrating a vehicular high pressure direct injection type injector with valve seat body for fuel-atomization according to the present invention.

200, 300, 400, 500, 600, 700, 800: nozzle hole
501, 601, 701, 801: stepped hole
201, 301, 403, 502, 602, 702, 802: valve seat surface
401: nozzle hole inlet side ellipse
402: nozzle hole outlet side ellipse
404, 603, 703, 803: inclination angle of nozzle hole

BEST MODE

The present invention will be described in detail below with reference to the accompanying drawings. In the following description, redundant descriptions and detailed descriptions of known functions and elements that may unnecessarily make the gist of the present invention obscure will be omitted. Embodiments of the present invention are provided to fully describe the present invention to those having ordinary knowledge in the art to which the present invention pertains. Accordingly, in the drawings, the shapes and sizes of elements may be exaggerated for the sake of clearer description.

FIG. 1 is a sectional view illustrating a high-pressure direct injection injector installed in vehicles according to the present invention.

As shown in FIG. 1, a needle valve 11 is disposed in a cylindrical housing 10, and a magnetic coil 12 is disposed around the needle valve 11. The magnetic coil 12 generates a magnetic field using current applied thereto through a line 13 to which an electric plug 17 is connected, thus moving the needle valve 11 upwards or downwards and controlling the needle valve 11. A valve seat body 15 is disposed below the needle valve 11. The valve seat body 15 has therein a nozzle hole 19 through which fuel is injected. Furthermore, disposed under a lower end of the needle valve 11, a ball 20 is placed on the valve seat body 15 at a position corresponding to an upper end of the nozzle hole 19. If no current is applied to the magnetic coil 12, the ball 20 disposed under the lower end of the needle valve 11 closes the nozzle hole 19. A fuel supply port 16 is connected to an upper end of the cylindrical housing 10 so that high-pressure fuel is injected into the cylindrical housing 10 through the fuel supply port 16. The needle valve 11 is moved upwards by the magnetic coil 12. At this moment, a space is formed between the ball 20 and the valve seat body 15. The high-pressure fuel is injected into a cylinder, which is disposed under the injector, along a valve seat surface 18 through the nozzle hole 19 which is formed in the valve seat body 15.

A return spring 14 is provided on an upper end of the needle valve 11. If current applied to the magnetic coil 12 is interrupted, the needle valve 11 is returned to its original state by restoring force of the return spring 14.

Figure 2A:
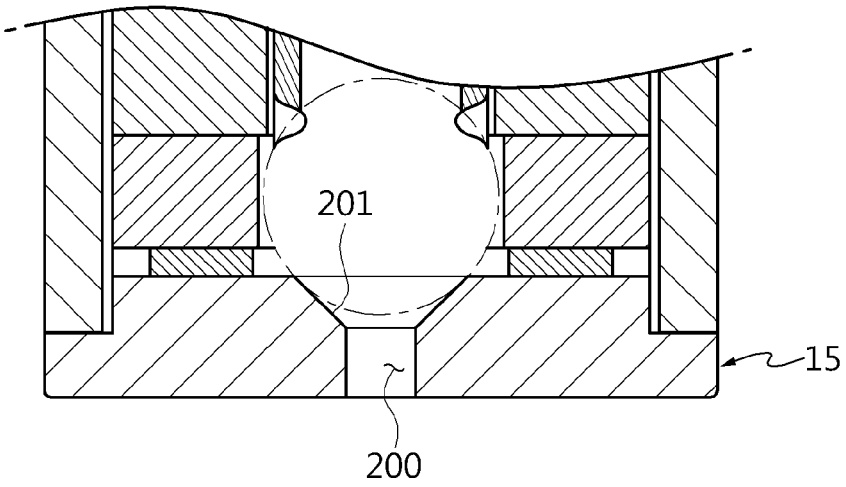
(PRIOR ART) FIG. 2A
FIGS. 2A through 2C are respectively a sectional view showing a nozzle of a conventional high-pressure direct injection injector for vehicles and a perspective view and a plan view showing a valve seat body.
Figure 2B:
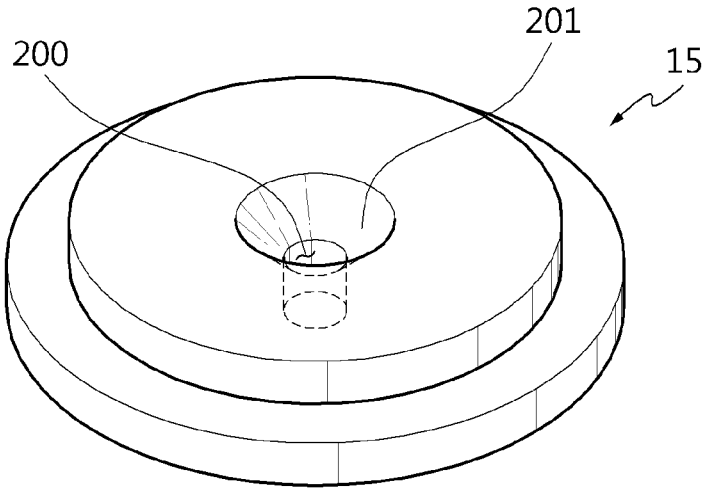
(PRIOR ART) FIG. 2B
Figure 2C:
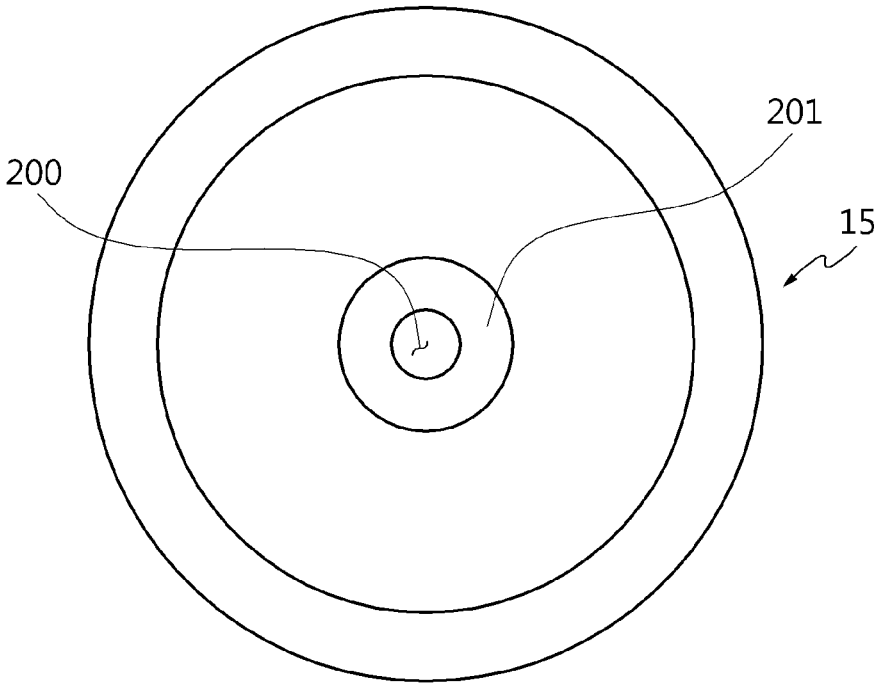
(PRIOR ART) FIG. 2C

FIGS. 2A through 2C are respectively a sectional view showing a nozzle of the conventional high-pressure direct injection injector for vehicles and a perspective view and a front view showing a valve seat body.

As shown in FIGS. 2A through 2C, a nozzle hole 200 is formed in the valve seat body 15 in a direction in which fuel is injected. A valve seat surface 201 onto which a ball 20 is seated is formed around an inlet of the nozzle hole 200. The nozzle hole 200 has a true-circular shape. In other words, a horizontal cross-section of the nozzle hole 200 has a true-circular shape with the same radius from the upper end thereof to the lower end. That is, the nozzle hole 200 has a cylindrical shape with the same cross-section from the upper end thereof to the lower end.

However, having a true-circular shape, the conventional nozzle hole 200 has problems in that the fuel injection length is relatively long and the fuel injection speed is comparatively low, so that fuel is not effectively atomized, and thus, because of incomplete combustion, the air pollution substance emission rate is high, and combustion byproducts are deposited in the nozzle hole causing the nozzle hole to be clogged with the deposited byproducts.

Figure 3A:
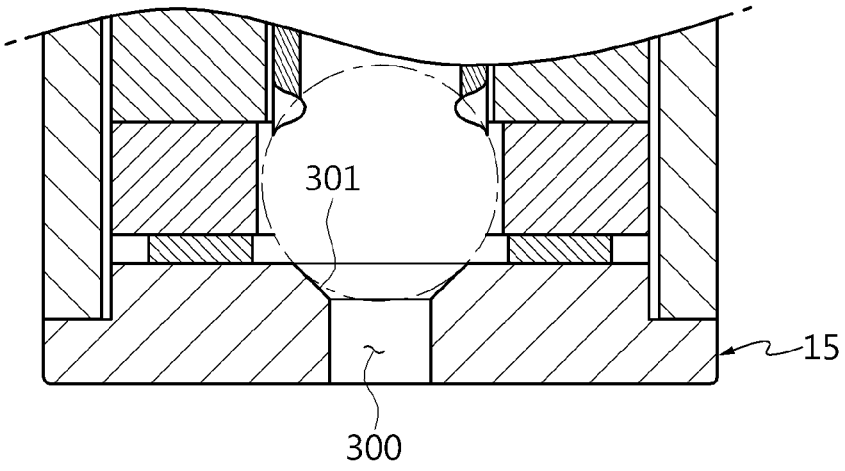
FIGS. 3A through 3C are respectively a sectional view, a perspective view and a plan view illustrating a nozzle of a vehicular high pressure direct injection type injector with valve seat body for fuel-atomization according to a first embodiment of the present invention.
Figure 3B:
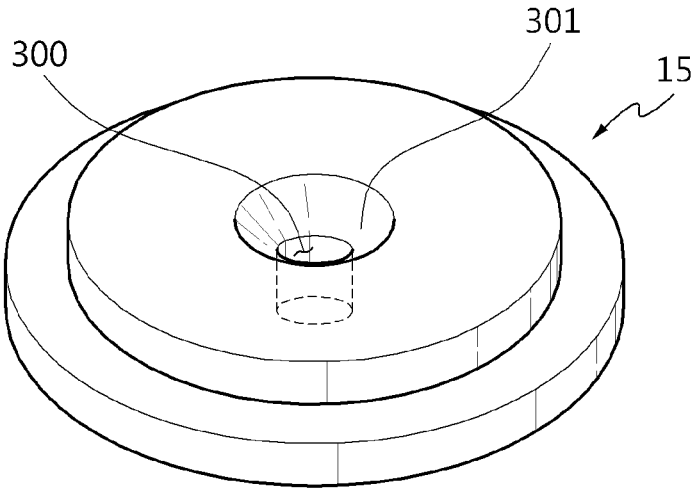
Figure 3C:
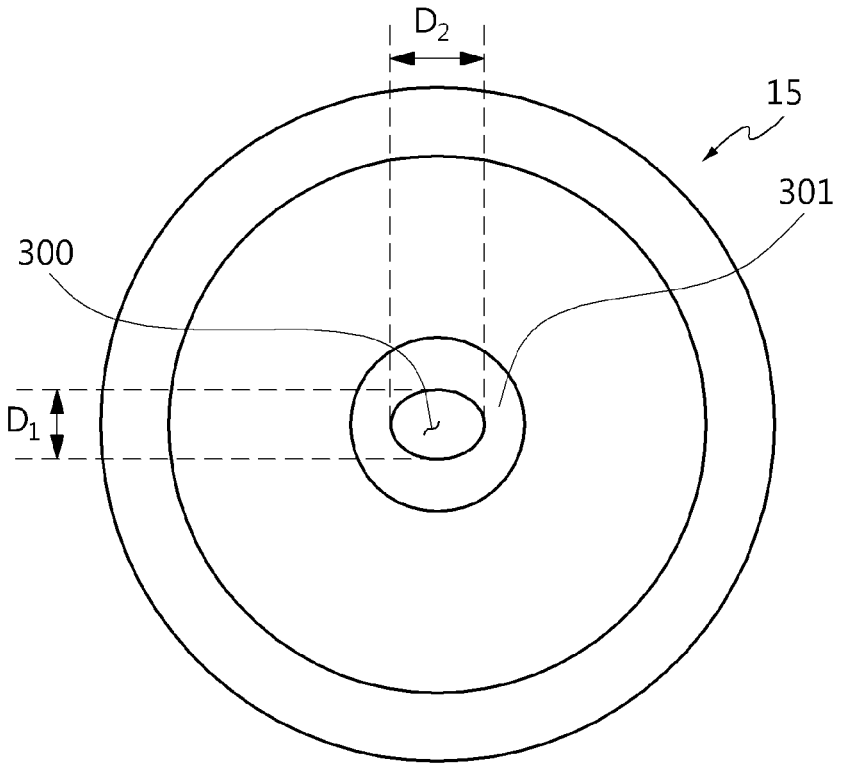

FIGS. 3A through 3C are respectively a sectional view, a perspective view and a front view illustrating a valve seat body of a high-pressure direct injection injector for vehicles according to a first embodiment of the present invention.

The injector for vehicles according to the present invention includes a cylindrical housing 10 which has a needle valve 11 therein, a magnetic coil 12 which reciprocates the needle valve 11, a current supply line 13 which supplies current to the magnetic coil 12, a return spring 14 which is disposed on an upper end of the needle valve 11 and applies restoring force to the needle valve 11, a valve seat body 15 which is disposed in a lower end of the cylindrical housing 10, and a ball 20 is disposed between the valve seat body 15 and the needle valve 11. The valve seat body 15 has a valve seat surface 18 onto which the ball 20 is seated, and a nozzle hole 300 which is formed in the valve seat body 15 in a direction in which fuel is injected. The nozzle hole 300 has an elliptical cross-sectional shape. FIG. 2 is an enlarged sectional view showing the valve seat body 15 provided in the lower end of the injector.

FIG. 3A is a sectional view showing the valve seat body of the injector according to the first embodiment of the present invention. In the first embodiment, the valve seat body 15 has the valve seat surface 301 onto which the ball 20 is seated, and the nozzle hole 300 which has an elliptical shape. In other words, extending from the upper surface to the lower surface of the valve seat body 15, the nozzle hole 300 is formed in the valve seat body 15. Reduced in diameter from the upper surface to the lower surface of the valve seat body 15, the valve seat surface 301 is formed around an upper end the nozzle hole 300. The valve seat surface 301 onto which the ball 20 provided under a lower end of needle valve 11 is seated has an inclined structure. When the needle valve 11 is seated onto the valve seat surface 301, the nozzle hole through which fuel is injected is closed.

Referring to FIGS. 3B and 3C, the valve seat body has in a central portion thereof the elliptical nozzle hole 300 which has a minor axis D1 and a major axis D2 which differ from each other. In the first embodiment, formed around the inlet of the nozzle hole 300, the valve seat surface 301 has a circular shape.

When the ratio of the minor axis D1 to the major axis D2 of the nozzle hole 300 is 1:1 to 3.5, fuel can be optimally atomized and complete combustion is promoted, thus enhancing the efficiency of the engine, and reducing noxious exhaust gas, thereby minimizing environmental pollution.

When the needle valve 11 is moved upwards by an actuator, fuel is injected through the nozzle hole 300. Particularly, the horizontal cross-section of the nozzle hole 300 has an elliptical shape. Compared to the conventional nozzle hole which has a true-circular shape, the nozzle hole 200 that has an elliptical shape increases the fuel injection speed, thus increasing the impulse with which injected fuel collides with air, whereby fuel atomization effect is enhanced. Therefore, complete combustion can be increased by a reduction in droplet size, whereby engine efficiency is increased, and improvements are achieved in terms of environmental pollutant emission.

Figure 4A:
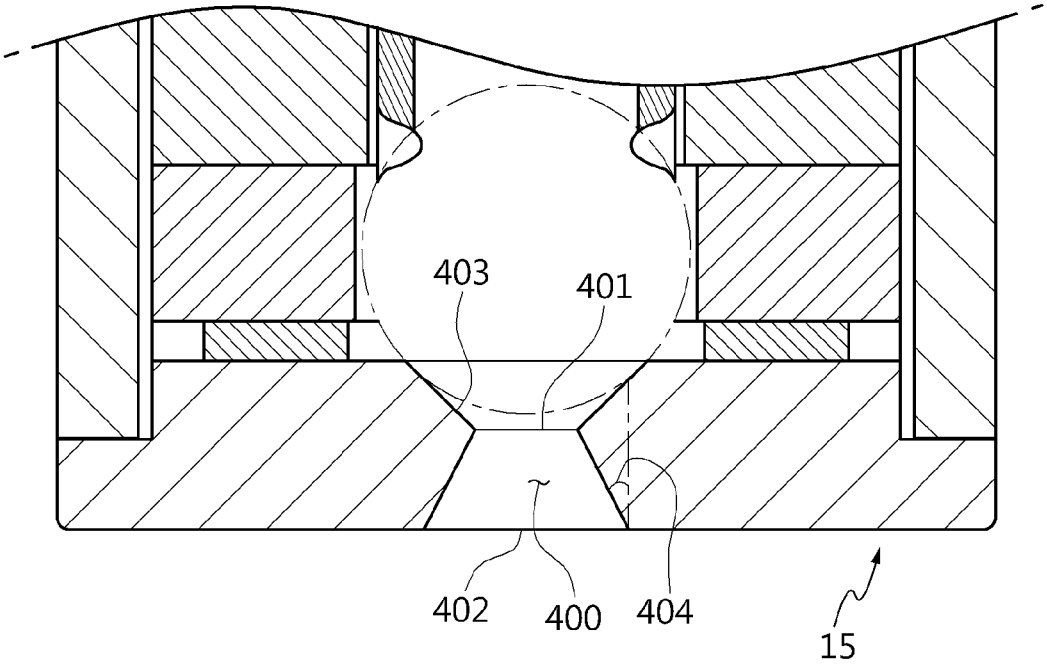
FIGS. 4A and 4B are respectively a sectional view and a perspective view illustrating a nozzle of a vehicular high pressure direct injection type injector with valve seat body for fuel-atomization according to a second embodiment of the present invention.
Figure 4B:
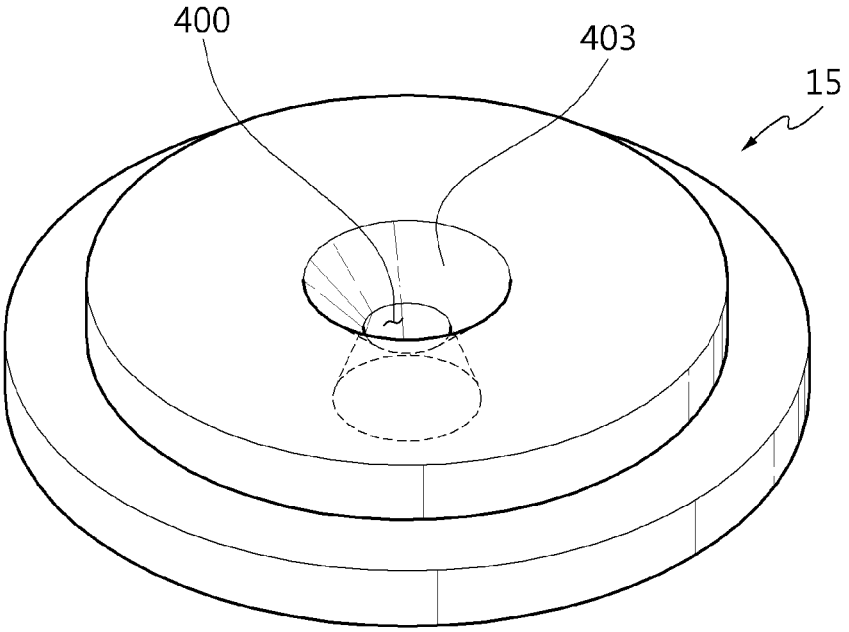

FIGS. 4A and 4B are respectively a sectional view and a perspective view showing a valve seat body of a high-pressure direct injection injector for vehicles according to a second embodiment of the present invention.

Referring to FIG. 4A, in the second embodiment, a nozzle hole 400 has an elliptical shape and is increased in cross-sectional area in a direction in which fuel is injected. Also, in the second embodiment, a valve seat surface 403 onto which a ball 20 is seated is formed around an inlet of the nozzle hole 400. The valve seat surface 403 is reduced in perimeter from the upper surface of a valve seat body 15 to the lower surface. The ball 20 provided under a lower end of a needle valve 11 is seated onto the valve seat surface 403 to openably close the nozzle hole 400. Particularly, in the second embodiment, the valve seat body 15 has a tapered surface which is increased in horizontal cross-sectional area from the upper end of the nozzle hole to the lower end.

Referring to FIG. 4B, the nozzle hole 400 has a tapered side surface which is increased in horizontal cross-sectional area in a direction in which fuel is injected. In other words, the major axis of an ellipse defined around an outlet of the nozzle hole is longer than that of an ellipse defined around the inlet of the nozzle hole, and the minor axis of the ellipse defined around the outlet of the nozzle hole is longer than that of the ellipse defined around the inlet of the nozzle hole. That is, the cross-sectional area of the ellipse 402 defined around the outlet of the nozzle hole is larger than the cross-sectional area of the ellipse 401 around the inlet of the nozzle hole.

Particularly, the nozzle hole 400 is configured such that an angle 404 between a direction in which the nozzle hole 400 is formed and a direction in which fuel is injected ranges from 0.1° to 10°. In other words, the angle of the inclined side surface of the nozzle hole 400 to the vertical axis ranges from 0.1° to 10°.

Also, the cross-section of the nozzle hole 400 is an ellipse having a minor axis to the major axis ratio of 1:1 to 3.5. Within this ratio range, the fuel atomization effect can be maximized.

Figure 5A:
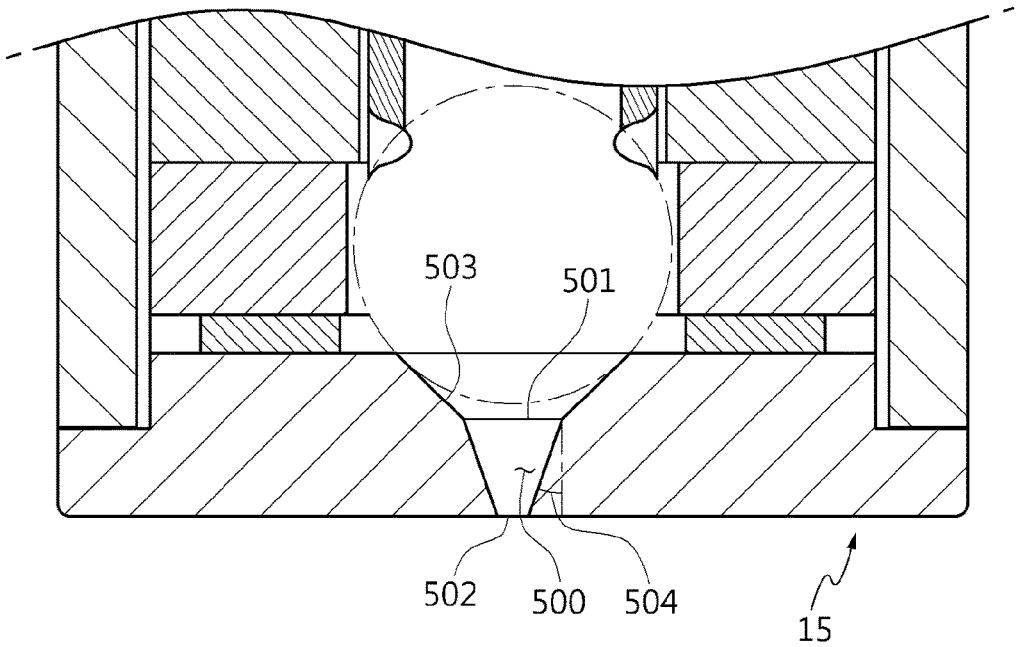
FIGS. 5A and 5B are respectively a sectional view and a perspective view illustrating a nozzle of a vehicular high pressure direct injection type injector with valve seat body for fuel-atomization according to a third embodiment of the present invention.
Figure 5B:
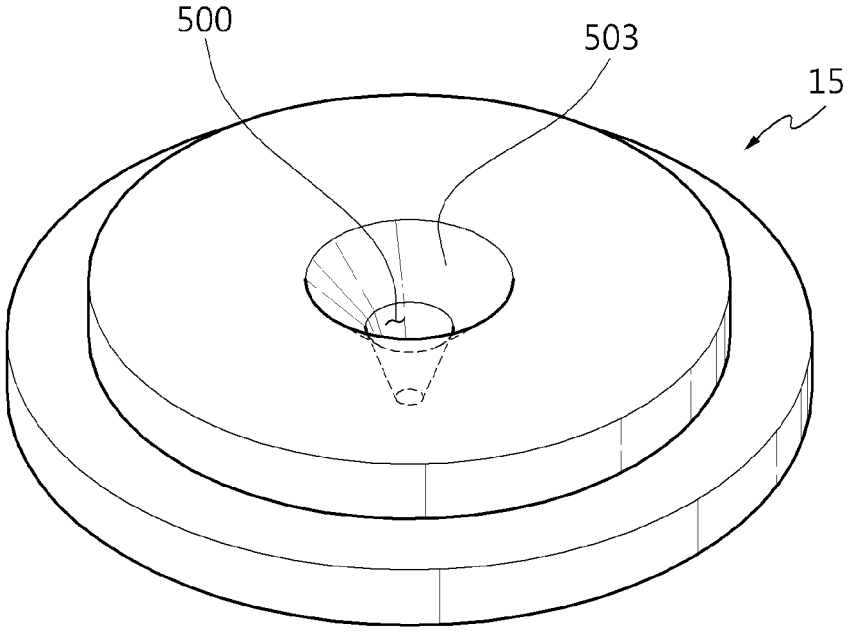

FIGS. 5A and 5B are respectively a sectional view and a perspective view illustrating a high-pressure direct injection injector having a fuel atomization valve seat body for vehicles according to a third embodiment of the present invention.

Referring to FIG. 5A, in the third embodiment, a nozzle hole 500 has an elliptical shape and is reduced in cross-section area in a direction in which fuel is injected. Also, in the third embodiment, a valve seat surface 503 onto which a ball 20 is seated is formed around an inlet of the nozzle hole 500. The valve seat surface 503 is reduced in perimeter from the upper surface of the valve seat body 15 to the lower surface. A ball 20 provided under a lower end of a needle valve 11 is seated onto the valve seat surface 503 to openably close the nozzle hole 500. Particularly, in the third embodiment, the valve seat body 15 has a tapered surface which is reduced in horizontal cross-sectional area from the upper end of the nozzle hole to the lower end.

Referring to FIG. 5B, the nozzle hole 500 has a tapered side surface which is reduced in horizontal cross-sectional area in a direction in which fuel is injected. In other words, the major axis of an ellipse defined around the inlet of the nozzle hole is longer than that of an ellipse defined around an outlet of the nozzle hole, and the minor axis of the ellipse defined around the inlet of the nozzle hole is longer than that of the ellipse defined around the outlet of the nozzle hole. That is, the cross-sectional area of the ellipse 501 defined around the inlet of the nozzle hole is larger than the cross-sectional area of the ellipse 502 defined around the outlet of the nozzle hole. As such, the nozzle hole has a tapered side surface which is reduced in horizontal cross-sectional area from the upper end of the nozzle hole to the lower end.

Particularly, the nozzle hole 500 is configured such that an angle 504 between a direction in which the nozzle hole 500 is formed and a direction in which fuel is injected ranges from 0.1° to 10°. In other words, the angle 504 of the inclined surface of the nozzle hole 500 to the vertical axis ranges from 0.1° to 10°.

Also, the cross-section of the nozzle hole 500 is an ellipse having a minor axis to the major axis ratio of 1:1 to 3.5. Within this ratio range, the fuel atomization effect can be maximized.

Figure 6A:
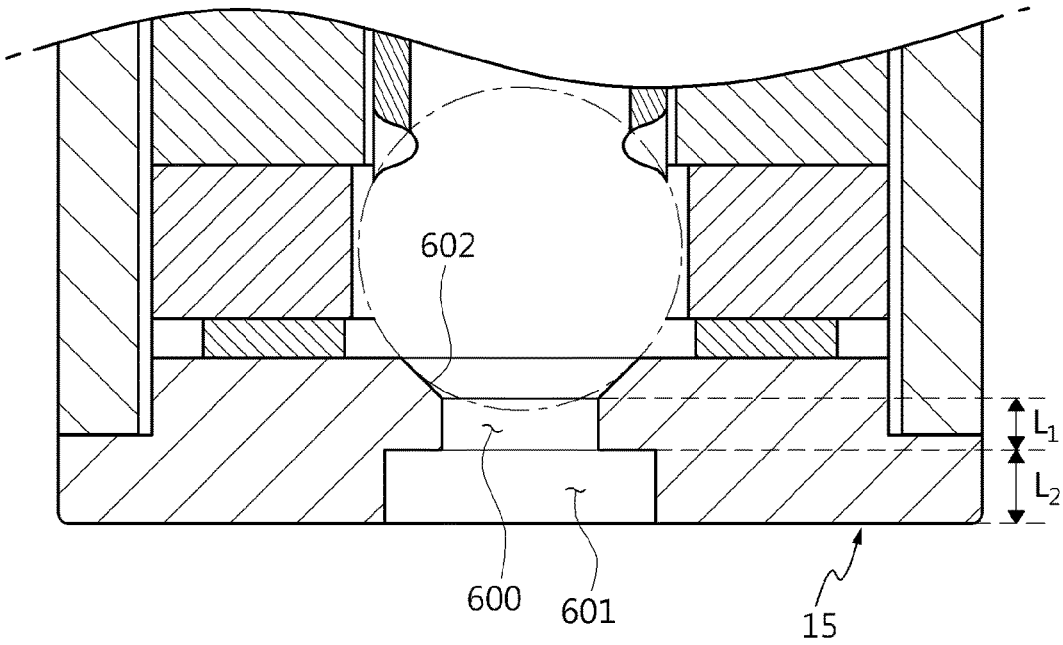
FIGS. 6A and 6B are respectively a sectional view and a perspective view illustrating a nozzle of a vehicular high pressure direct injection type injector with valve seat body for fuel-atomization according to a fourth embodiment of the present invention.
Figure 6B:
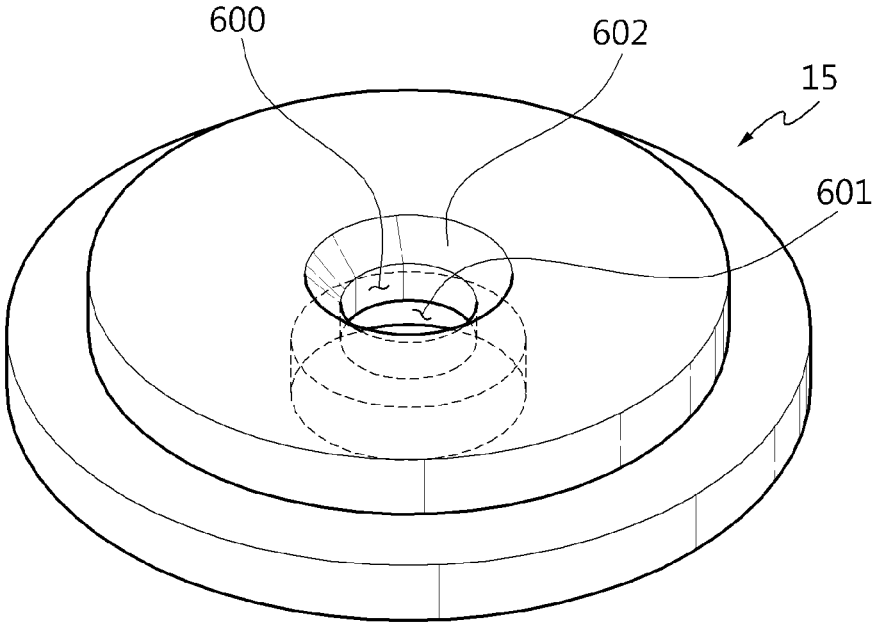

FIGS. 6A and 6B are respectively a sectional view and a perspective view illustrating a high-pressure direct injection injector having a fuel atomization valve seat body for vehicles according to a fourth embodiment of the present invention.

Referring to FIGS. 6A and 6B, a nozzle hole 600 has an elliptical shape. Having a larger cross-sectional area than that of the nozzle hole 600, a stepped hole 601 is additionally formed. Also, a valve seat surface 602 onto which a ball 20 is seated is formed around an inlet of the nozzle hole. The valve seat surface 602 onto which the ball 20 provided under a lower end of a needle valve 11 is seated is downwardly inclined. As such, because the valve seat surface 602 has a tapered shape, when the needle valve 11 is seated onto the valve seat surface 602, fuel can be reliably prevented from leaking.

While the cross-section of the nozzle hole 600 is elliptical, the cross section of the stepped hole 601 may be elliptical or circular or, alternatively, it may have other shapes. Preferably, the stepped hole 601 has a sufficient size so as to not be involved in injection of fuel from the nozzle hole 600.

The nozzle hole 600 and the stepped hole 601 form a stepped cross-sectional shape. Fuel is injected from the valve seat body 15 in order from the nozzle hole 600 to the stepped hole 601. As such, the stepped hole 601 is formed under the nozzle hole 600, so that combustion byproducts are deposited in an upper portion of the stepped hole 601, thus fundamentally preventing the nozzle hole 600 from clogging.

Figure 7A:
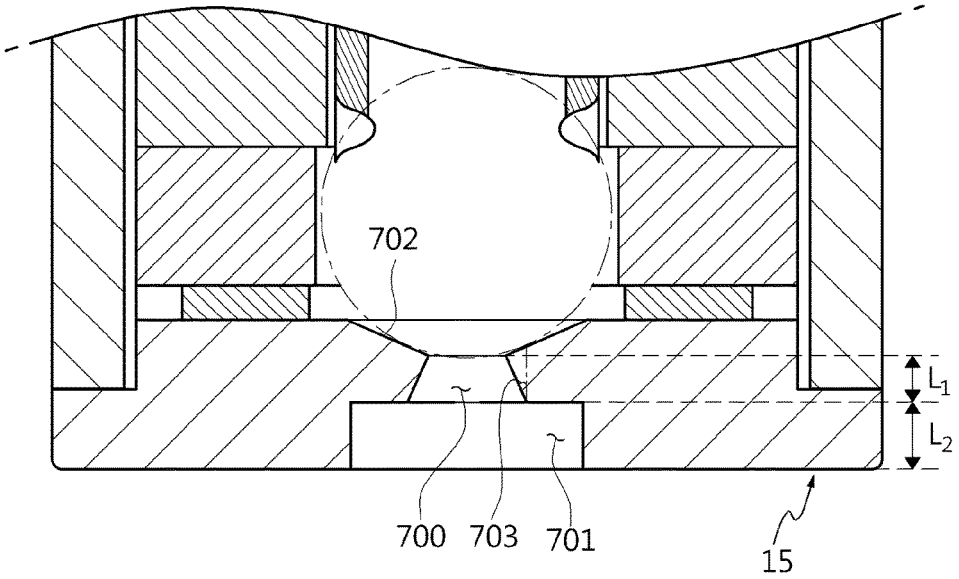
FIGS. 7A and 7B are respectively a sectional view and a perspective view illustrating a nozzle of a vehicular high pressure direct injection type injector with valve seat body for fuel-atomization according to a fifth embodiment of the present invention.
Figure 7B:
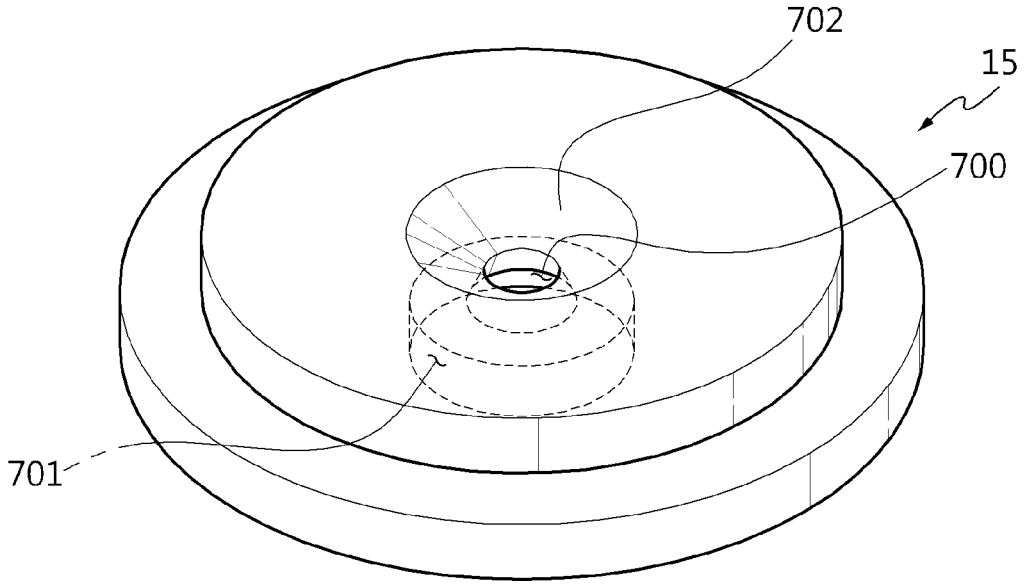

FIGS. 7A and 7B are respectively a sectional view and a perspective view a high-pressure direct injection injector having a fuel atomization valve seat body for vehicles according to a fifth embodiment of the present invention.

Referring to FIGS. 7A and 7B, a nozzle hole 700 has an elliptical shape. Having a larger cross-sectional area than that of the nozzle hole 700, a stepped hole 701 is additionally formed. In detail, the horizontal cross-section of the nozzle hole 700 is elliptical, and the stepped hole 701 is formed under the nozzle hole 700. The nozzle hole 700 has a truncated conical shape which is increased in elliptical horizontal cross-sectional area from the upper end thereof to the lower end. In other words, the nozzle hole 700 has an inclined side surface formed in such a way that the perimeter of the nozzle hole 700 having an elliptical horizontal cross-section is increased in a direction in which fuel is injected. Having a larger cross-sectional area than that of the nozzle hole 700, the stepped hole 701 is formed under the nozzle hole 700.

Also, the nozzle hole 700 has a shape in which the area of an elliptical cross-section thereof is increased in the direction in which fuel is injected. The nozzle hole 700 has a height of L1, and the stepped hole 701 has a height of L2.

The stepped hole 701 has a sufficient size so as to minimize influence on atomization of fuel. The nozzle hole 700 has a truncated conical shape, the lower end of which is larger in cross-sectional area than the upper end thereof. Also, when a ratio of the minor axis of the nozzle hole 700 and the major axis is 1:1 to 3.5, the atomization effect is maximized. When the cross-section of the nozzle hole 700 is an ellipse, the major axis of which is 1 to 3.5 times longer than the minor axis thereof, the droplet size (SMD) reduction effect is enhanced. By virtue of enhanced atomization effect, complete combustion is achieved, and the efficiency of the engine can be enhanced.

A circular valve seat surface 702 onto which a ball is seated to openably close the nozzle hole is formed around an inlet of the nozzle hole 700. Particularly, an angle 703 between a direction in which the nozzle hole 700 is formed and a direction in which fuel is injected ranges from 0.1° to 10°.

Figure 8A:
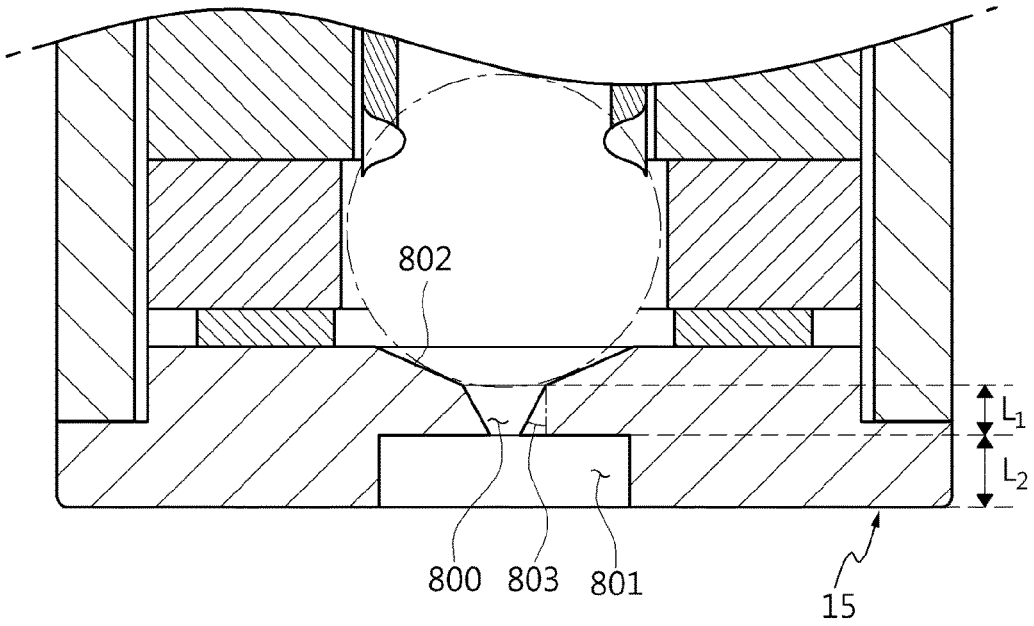
FIGS. 8A and 8B are respectively a sectional view and a perspective view illustrating a nozzle of a vehicular high pressure direct injection type injector with valve seat body for fuel-atomization according to a sixth embodiment of the present invention.
Figure 8B:
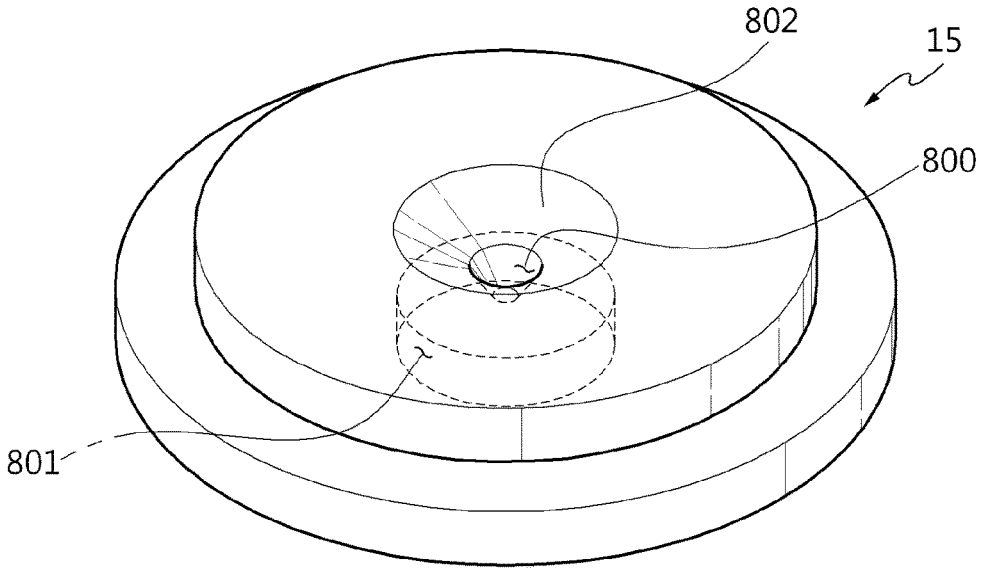

FIGS. 8A and 8B are respectively a sectional view and a perspective view illustrating a valve seat body of a high-pressure direct injection injector for vehicles according to a sixth embodiment of the present invention.

Referring to FIGS. 8A and 8B, a nozzle hole 800 has an elliptical shape. Having a larger cross-sectional area than that of the nozzle hole 800, a stepped hole 801 is additionally formed. In detail, the nozzle hole 800 has an elliptical horizontal cross-section, and the stepped hole 801 is formed under the nozzle hole 800. The nozzle hole 800 has a reverse truncated conical shape which is reduced in elliptical horizontal cross-sectional area form the upper end to the lower end. Also, the nozzle hole 800 having an elliptical cross-sectional shape is reduced in cross-sectional area in the direction in which fuel is injected. The nozzle hole 800 has a height of L1, and the stepped hole 801 has a height of L2.

The nozzle hole 800 has a tapered shape which is reduced in elliptical cross-sectional area from the upper end to the lower end so as to increase the fuel injection speed. The stepped hole 801 is formed under the nozzle hole 800, so that combustion byproducts are prevented from being deposited in the nozzle hole 800, thus preventing the nozzle hole 800 from clogging. Here, the stepped hole 801 has a sufficient size so as to minimize influence on atomization of fuel which is injected from nozzle hole 800.

Figure 9:
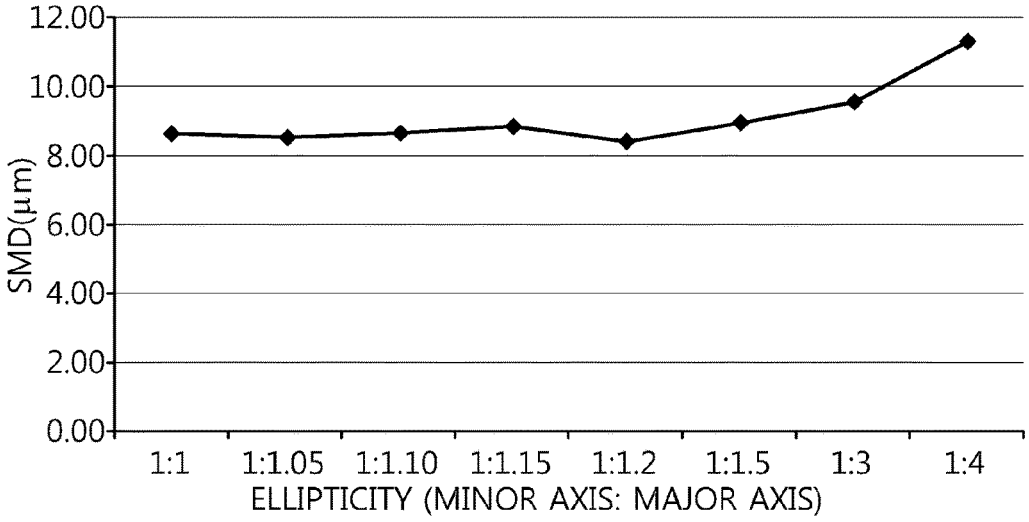
FIG. 9 is a view showing test data of the size of a droplet as a function of ellipticity of the vehicular high pressure direct injection type injector with valve seat body for fuel-atomization according to the sixth embodiment of the present invention.

Furthermore, when a ratio of the minor axis of an elliptical cross section of the nozzle hole 800 and the major axis is 1:1 to 3.5, the atomization effect is maximized. FIG. 9 illustrates test data related to this. The X-axis of the graph denotes the ellipticity that is a ratio between the minor axis and the major axis. The Y-axis denotes the diameter of a droplet (μm) of injected fuel. FIG. 9 is a view showing test data related to relationship between the size of a droplet and the ellipticity. According to the test data, when the ratio of the minor axis to the major axis is 1:1.2, the diameter of a droplet is smallest, thus having the largest atomization effect. Similar effects are obtained until the ratio of the minor axis to the major axis becomes 1:3, after which, as the ratio increases, the diameter of the droplet is increased.

In other words, when the nozzle hole 800 has an elliptical cross-section shape the major axis of which is 1 to 3.5 times longer than the minor axis thereof, the droplet size (SMD) reduction effect is comparatively high. In addition, by virtue of enhanced atomization effect, complete combustion can be achieved, and the efficiency of the engine can also be enhanced.

A circle valve seat surface 802 onto which the ball is seated to openably close the nozzle hole 800 is formed around an inlet of the nozzle hole 800. Particularly, when an angle 803 between a direction in which the nozzle hole is formed and a direction in which fuel is injected ranges from 0.1° to 10°, fuel can be optimally atomized and complete combustion is promoted, thus enhancing the efficiency of the engine, and reducing noxious exhaust gas, thereby minimizing environmental pollution.

As described above, in a high-pressure direct injection injector having a fuel atomization valve seat body for vehicles according to the present invention, fuel can be more optimally atomized. Thereby, complete combustion can be achieved, thus enhancing the efficiency of the engine, and reducing noxious exhaust gas, thereby minimizing environmental pollution.

Furthermore, improvement in the shape of the nozzle hole can minimize combustion byproducts that are created by operation of the injector for vehicles from being deposited in the nozzle. As a result, the combustion efficiency of the engine can be enhanced, and the nozzle clogging problem can be prevented.

This invention may, however, be embodied in many different forms, and should not be construed as limited to the embodiments set forth herein. Rather, all changes that fall within the bounds of the present invention, or the equivalence of the bounds are therefore intended to be embraced by the present invention.

The invention claimed is:

1. A vehicular high pressure direct injection type injector with valve seat body for fuel-atomization, the injector comprising:

a cylindrical housing having a needle valve therein;

a magnetic coil arranged for reciprocating the needle valve;

a current supply line arranged for supplying current to the magnetic coil;

a return spring disposed at an upper end of the needle valve, the return spring arranged for applying a restoring force to the needle valve;

a valve seat body disposed at a lower end of the cylindrical housing; and a ball disposed between the valve seat body and the needle valve, wherein the valve seat body includes:

a valve seat surface structured to accommodate the ball in a seated position, a nozzle hole located under the valve seat surface in a direction in which fuel is injected, and a stepped hole formed under the nozzle hole in the direction in which fuel is injected, the stepped hole having a horizontal cross-sectional area that is greater than a largest horizontal cross-sectional area of the nozzle hole, each of the horizontal cross-sectional areas being in a plane perpendicular to the direction in which fuel is injected, wherein a horizontal cross-section of the nozzle hole is shaped as an ellipse having a minor axis to a major axis ratio in a range of greater than 1:1 up to 1:3.5, and wherein the nozzle hole has a reverse truncated conical shape with a side surface that is tapered in the direction in which fuel is injected, such that the horizontal cross-sectional area of the nozzle hole decreases in the direction in which fuel is injected.

2. The vehicular high pressure direct injection type injector with valve seat body for fuel-atomization as set forth in claim 1, wherein the valve seat body includes a plurality of the nozzle holes.

* * * * *